United States Patent [19]

Giuffredi

[11] 4,417,674

[45] Nov. 29, 1983

[54] VALVE FOR THE ADMIXTURE OF FLUIDS AND DELIVERY OF THE RESULTING MIXTURE

[75] Inventor: Giancarlo Giuffredi, Milan, Italy

[73] Assignee: Coster Tecnologie Speciali S.p.A., Milan, Italy

[21] Appl. No.: 26,001

[22] Filed: Apr. 2, 1979

[30] Foreign Application Priority Data

Apr. 13, 1978 [IT] Italy ..... 22268 A/78

[51] Int. Cl.[3] ..... B65D 83/14

[52] U.S. Cl. ..... 222/402.18; 239/311

[58] Field of Search ..... 222/402.1, 399, 402.18, 222/402.19, 402.24, 464; 239/311, 372, 573, 594, 579

[56] References Cited

U.S. PATENT DOCUMENTS

| | | | |
|---|---|---|---|
| 3,211,349 | 10/1965 | Prussin et al. | 222/402.18 |
| 3,217,936 | 11/1965 | Abplanalp | 222/402.18 |
| 3,311,274 | 3/1967 | Green | 222/402.18 |
| 3,587,942 | 6/1971 | Gailitis | 222/402.24 |
| 3,685,695 | 8/1972 | Yuhas | 222/402.1 |
| 3,688,511 | 9/1972 | Harmstrof | 239/311 |
| 4,061,252 | 12/1977 | Ricco | 222/402.18 |

*Primary Examiner*—H. Grant Skaggs

[57] ABSTRACT

A valve for the admixture of a gas with a fluid pressure stored in a container, comprising a hollow body associated with a drawing tube for the fluid transport and provided with at least one through hole for the gas transport, as well as a shutter element movable in the body against a spring and provided with a hollow stem having at least one opening which can be shut off by a sealing gasket. The body has therein a nozzle which is hydraulically connected with the drawing tube and cooperates with a venturi effect conduit which with such a nozzle defines an annular space communicating with said through hole for the gas transport.

5 Claims, 4 Drawing Figures

VALVE FOR THE ADMIXTURE OF FLUIDS AND DELIVERY OF THE RESULTING MIXTURE

TECHNICAL FIELD

This invention relates to an improved valve for use on bottles or similar vessels, in which a propellant gas and a fluid product are stored under pressure.

BACKGROUND OF THE PRIOR ART

From the Italian Patent Specification No. 1,012,693 in the same applicant's name a valve is known, as commonly referred to as an aerosol valve, in the body of which at the bottom thereof a through hole is provided, enabling when the valve is pressed the delivery of the product mixed with the propellant gas. These prior art valves do not allow a thorough mixing of the components, unless large amounts of propellant gas are used. Should the propellant gas be flammable (such as butane and propane), the high concentrations of propellant gas may be hazardous to persons' safety.

Therefore, it is the object of the present invention to provide an improved valve enabling a thorough admixture of the components with low concentrations of propellant.

BRIEF SUMMARY OF THE INVENTION

An improved valve for the admixture of a gas with a fluid stored under pressure in a container comprises a hollow body associated with a drawing tube for the gas transport or conveyance, and a shutter element movable in said body against a spring and provided with a hollow stem having at least one opening that can be shut off by a sealing gasket, is characterized in that: said body has therein a nozzle which is hydraulically connected with the drawing tube and cooperates with a venturi effect conduit which together with such a nozzle defines an annular space, said through hole for the gas transport or conveyance opening therein.

BRIEF DESCRIPTION OF THE DRAWINGS

The invention will be more clearly understood from the following detailed description, given by mere way of unrestrictive example, of some preferred embodiments thereof shown in the accompanying drawings, in which.

DETAILED DESCRIPTION OF THE INVENION

Figure 1:
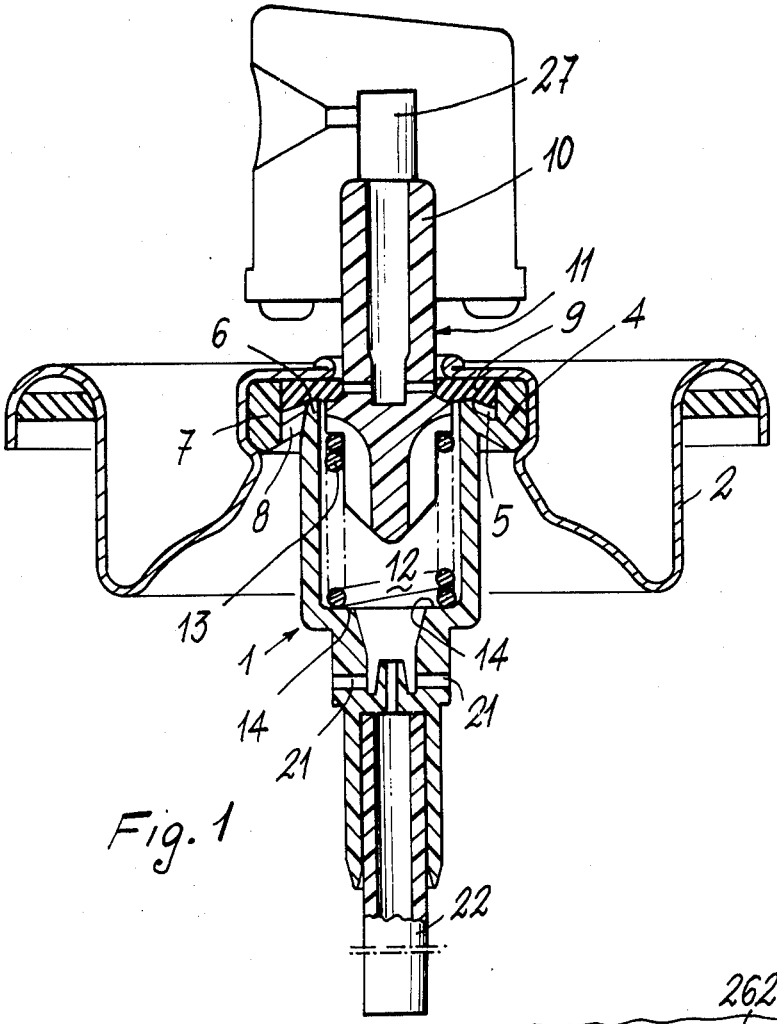
FIG. 1 is an axial sectional view showing a valve according to the invention at inoperative position.
Figure 2:
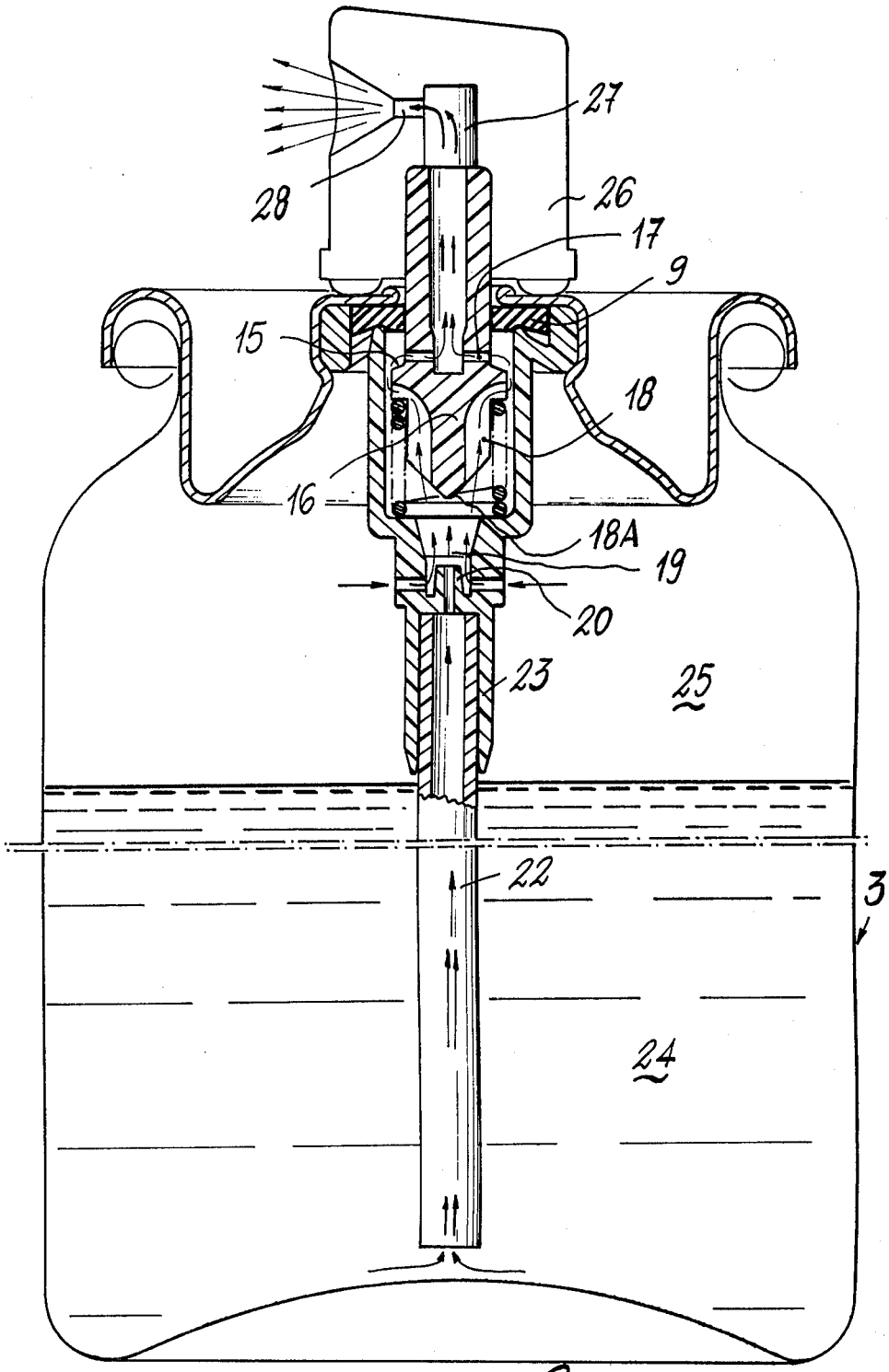
FIG. 2 is an axial sectional view showing the valve of FIG. 1 at operative position, that is at delivery or dispensing position.

Referring to FIGS. 1 and 2, a mixing and dispensing valve comprises a hollow body 1 seamed to a bottom or cup 2 which, in turn, can be applied in a per se known manner to a bottom or similar container 3 wherein a propellant gas, such as butane or propane, and a liquid product, such as a perfume, are stored. Adjacent to its upper end, said body 1 has a flange 4, in which an annular channel 5 is provided as defined internally by a side 6 of a lower height than the outer side 7.

In the bottom wall of channel or groove 5 windows 8 are provided, and the inner side 6 has a resilient sealing ring 9 bearing thereon, which is compressed on one side by side 6 and on the other side by cup 2.

The hollow stem 10 of an element 11 extends through the central hole of ring 9, the remaining part 16 of which is accomodated within the cylindrical cavity or recess 12 of body 1.

This element 11 is axially movable against a spring 13 bearing at the bottom against a step 14, at the level of which said cylindrical cavity or recess 12 terminates.

Under the rest or inoperative conditions of FIG. 1, assuming that the cup 2 is seamed to the container 3, the valve sealing is ensured by an upper annular edge 15 of the portion 16 urged against the sealing ring 9 by the spring 13 and by the same ring 9 which sealingly shuts it off by adhering against the stem contour at the level of a series of radial openings 17 of said stem.

The portion 16 of shutter element 11 has one or more grooves 18, preferably of helical type and in the same number as that of said radial openings 17. The lower end of portion 16 terminates with a substantially conical face or surface 18A.

At the lower end or portion of body 1 an ejector is provided as comprising: (a) a conduit 19, which is partly of cylindrical and partly of conical shape, and opens in the cylindrical cavity or chamber 12; (b) a nozzle 20 projecting from the bottom of conduit 19; and (c) a series of through holes 21 opening in conduit 19 at the annular space internally defined by the projection of nozzle 20 and externally by the wall of said conduit 19.

In operation, this conduit 19 provides a venturi effect. Nozzle 20 communicates with the drawing tube 22 which, according to well known techniques, is forced into a tubular extension 23 of body 1 and draws in the liquid volume 24 stored in container 3. The radial through holes 21 communicate the gas volume 25 stored in container with conduit 19.

The operation is as follows:

Assume that an ordinary dispensing pushbutton 26 provided with conduits 27 and atomizing nozzle 28 is mounted on stem 10. By pressing the pushbutton 26, the shutter element 11 is lowered against the spring 13. The annular edge 15 and openings 17 are moved away from the sealing ring 9, so that the inside of container 3 is communicated with the nozzle 28 on pushbutton 26. The liquid 24 stored in the container or vessel 3 arrives through the drawing tube 22 at said nozzle 20, therefrom passing to the conduit 19 where it becomes mixed with the gas from the through holes 21. The gas-liquid mixture flows through the helical grooves 18 and enters the holes 17, exiting in atomized form from the nozzle 28 of pushbutton 26. The fluid path is shown by the arrows in FIG. 2.

Figure 3:
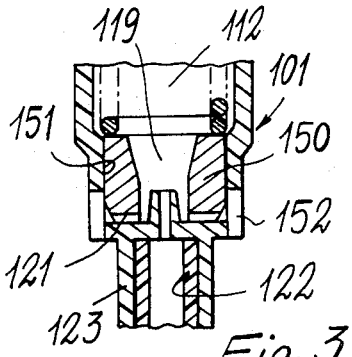
FIG. 3 is an axial sectional view showing a detail of a modified embodiment of the valve.

The embodiment of FIG. 3, in which the same reference numerals added by 100 have been used to indicate equal or similar parts, differs from the former only in that the venturi tube 119 and gas passages 121 are formed in an insert 150. This insert 150 is forced into body 101 in a cylindrical seat 151 of the latter. Such a seat is located as a continuation of the cylindrical cavity or chamber 112. On the lower face or underside of insert 150 there are radial grooves which, together with the bottom wall of seal 151, comprise the above mentioned passages 121. Windows or slits 152 are provided at such passages in the wall of body 101, through which the gas is admitted to passages 121.

Figure 4:
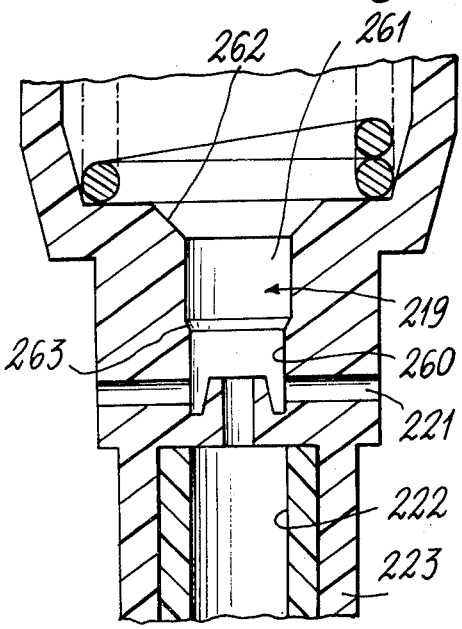
FIG. 4 is an axial sectional view showing a detail of a further modified embodiment of the valve according to the invention.

The modified embodiment shown in FIG. 4, in which the same or corresponding parts are designated by the same reference numerals added by 200, differs from the first embodiment only in that the conduit 219 comprises three sections, two cylindrical sections 260 and 261 but of different diameter, and one conical section 262. The passage between one to the other cylindrical section is through a short conical transition zone 263.

Although only some embodiments have been described, those skilled in the art will now readily devise many changes and modifications, but all of which are to be understood as within the scope of the invention.

What is claimed is

1. A valve for admixture, during dispensing of a liquid stored under gas pressure with a controlled portion of the pressurizing gas, said valve being of the type including: a hollow body with upper and lower ends, said lower end being connected to a suction tube, said valve having integral gasketed sealing means at the upper end, said body having at least one transverse hole for gas transport, said valve also including a valve plunger movable within the body and resilient bias means between the valve plunger and the body, the valve having a hollow stem for dispensing the mixture, said valve further comprising:

a nozzle formed integrally with the body, said nozzle being located at said lower end of the body and connected to the suction tube; and a passageway within the body, said passageway having an annular portion surrounding said nozzle and a portion extending beyond the nozzle, the cross-sectional area of said passageway being greater in said extended portion beyond the nozzle than the cross-sectional area in the annular portion of said passageway surrounding said nozzle, the annular portion of said passageway communicating with the transverse gas transport holes, said nozzle, said passageway, and said transverse holes forming a venturi-effect ejector whereby liquid flowing through the nozzle entrains gas flowing through said transverse holes, with mixing of the gas and the liquid during expansion in the extended portion of the passageway.

2. A valve as claimed in claim 1, wherein the valve plunger within the body is further provided with grooves to enhance the flow of the gas and liquid mixture to the dispensing stem.

3. A valve as claimed in claim 2, wherein the hollow stem has transverse holes which communicate with the interior of the body when the valve is opened and wherein said grooves provided in the plunger are equal in number to the number of transverse holes in the stem.

4. A valve as claimed in claim 1, wherein said passageway is provided in an insert mounted in the body, said insert having transverse passageways which communicate with the transverse gas transport holes in the body.

5. A valve as claimed in claim 4, wherein the underside of said insert is provided with transverse grooves, said grooves defining channels for communication with the transverse gas transport holes in the body.

* * * * *